US006516860B1

(12) United States Patent
Weaver et al.

(10) Patent No.: US 6,516,860 B1
(45) Date of Patent: Feb. 11, 2003

(54) DEVICE FOR SAFELY CONTAINING AND OPERATING LIFT CORDS OF A VERTICAL COVERING

(76) Inventors: E. Leon Weaver, 610 W. Ash St., Suite 1600, San Diego, CA (US) 92101; Sergio Ruffo Appel, Santurno 309 Planatario, Tijuana, Baja (MX), 22470

( * ) Notice: Subject to any disclaimer, the term of this patent is extended or adjusted under 35 U.S.C. 154(b) by 0 days.

(21) Appl. No.: 09/965,516

(22) Filed: Sep. 25, 2001

(51) Int. Cl.[7] ..... E06B 9/30

(52) U.S. Cl. ..... 160/168.1 R; 160/178.2 R

(58) Field of Search ..... 160/168.1 R, 176.1 R, 160/178.2 R, 172 R, 173 R, 178.1 R, 177 R, 107

(56) References Cited

U.S. PATENT DOCUMENTS 5,465,775 A * 11/1995 Biba et al. ..... 160/168.1 R
5,472,035 A * 12/1995 Biba et al. ..... 160/168.1 R
5,501,262 A * 3/1996 Inaba et al. ..... 160/178.2 R
5,513,687 A * 5/1996 Tuzmen et al. ..... 160/168.1 R
5,553,649 A * 9/1996 Chisaka et al. ..... 160/168.1 R
5,553,653 A * 9/1996 Rozon ..... 160/173 R
5,671,793 A * 9/1997 Lee ..... 160/168.1 R
5,722,478 A * 3/1998 Claypool et al. ..... 160/173 R
5,749,405 A * 5/1998 Huang ..... 160/168.1 R
5,850,863 A * 12/1998 Huang ..... 160/168.1 R
5,904,198 A * 5/1999 Huang ..... 160/168.1 R
6,196,293 B1 * 3/2001 Lee ..... 160/168.1 R

* cited by examiner

*Primary Examiner*—David M. Purol
(74) *Attorney, Agent, or Firm*—Thomas J. Tighe

(57) ABSTRACT

A telescoping wand safely encloses the control ends of a set of lift cords of vertically raisable "blinds" (as defined in the specification). The wand includes a selectively releasable cord locking mechanism which cooperates with a lift cord tensioner and a cord locking mechanism in the blinds' headrail to allow a user to raise and lower the blinds by one-handed operation of the wand. The blinds are raised by reciprocatingly moving an outer handle tube telescopically along a stationary inner tube. Each time the handle is pumped up and down, the blinds are raised a discrete amount. The wand's cord locking mechanism allows the lift cords to slip through the wand on the handle's upward stroke, but grabs and pulls the lift cords on the handle's downward stroke. Two or three quick pumps of the handle are all that is typically needed to fully raise a set of blinds. To lower the blinds, the wand is manipulated to simultaneously release the headrail's cord lock and the wand's cord lock, allowing the lift cords to freely slip through the wand which in turn allows the blinds to drop down by their own weight. By proper control of the wand, the blinds can be secured at any desired level.

13 Claims, 9 Drawing Sheets

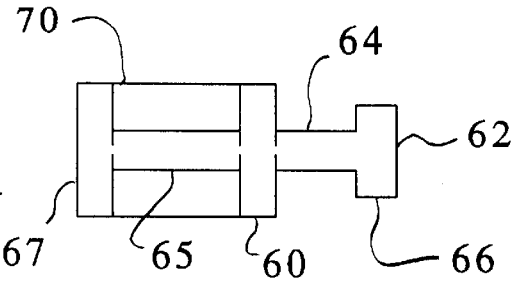
FIG. 5A
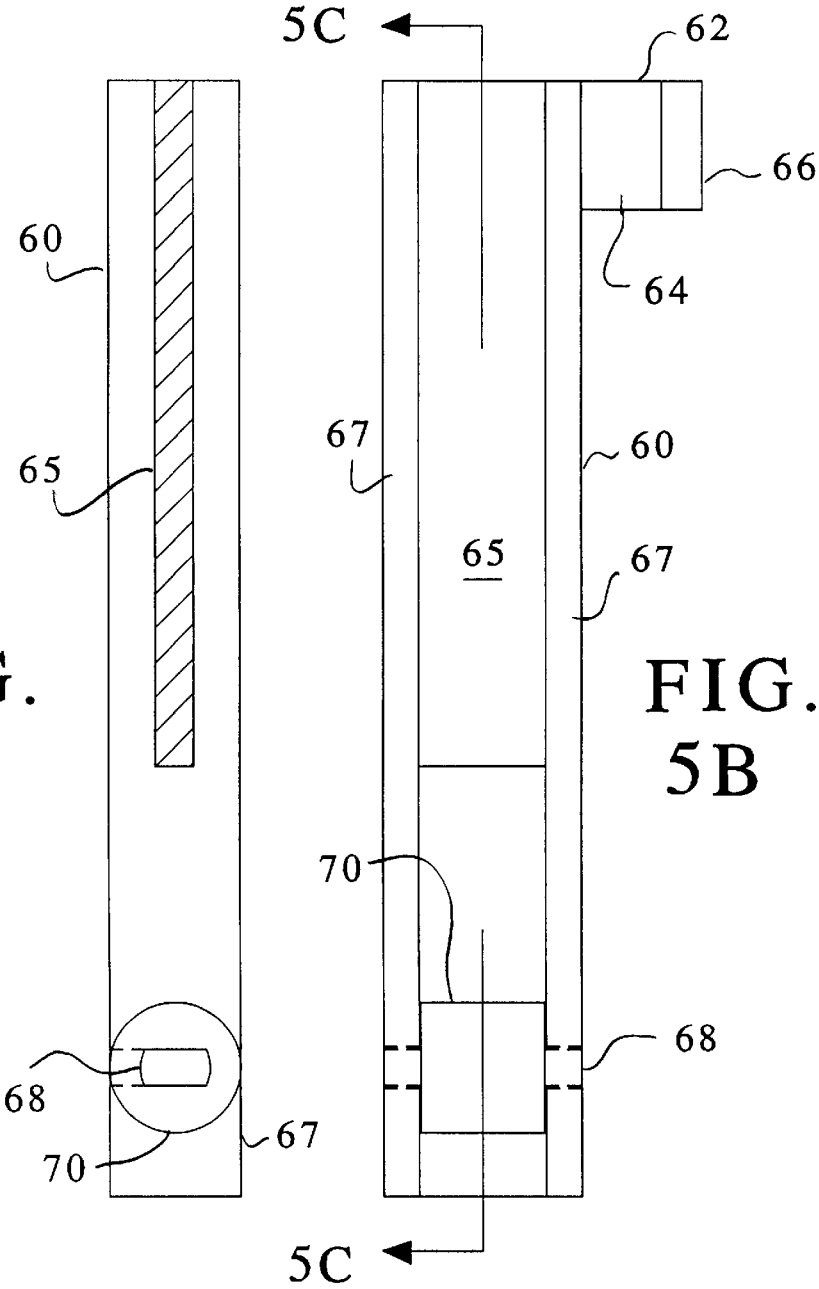
FIG. 5C
FIG. 5B

DEVICE FOR SAFELY CONTAINING AND OPERATING LIFT CORDS OF A VERTICAL COVERING

BACKGROUND OF THE INVENTION

This invention relates in general to the field of blinds and other vertically hung coverings or screens which can be raised by pulling down on a set (one or more) of lift cords, e.g., Venetian blinds and any other vertically hung coverings raised and lowered in similar fashion, and more particularly to such incorporating a pump-action "wand" for safely containing the control end(s) of the set of lift cords and for operating the same.

As used herein and in the claims appended hereto, the terms "blind" or "blinds" shall refer to any types or configurations of blinds which can be raised or foreshortened, wholly or in part, by pulling on a set of cords, and to any other vertically hung coverings or screens which can be raised in similar fashion.

This invention can be used to particular advantage on horizontal blinds, e.g., Venetian blinds. Conventionally, the raising and lowering of horizontal blinds have been controlled by one or more "lift" cords attached at their remote ends to a base rail of the blinds and strung through vertically aligned holes in the slats to a headrail in which they are strung around pulleys or rollers and through the headrail and ultimately down through a headrail cord lock where their control ends are left dangling. (As used herein, "headrail" includes in general any structure at the top of a blind containing cord redirecting elements, e.g., pulleys and rollers, and which conventionally contain cord locking mechanisms.) Pulling down on the lift cords causes the base rail to be pulled up to a level corresponding to the amount that the lift cords were vertically displaced downward. As the base rail is pulled up, slats encountered by the base rail collapse against it. Releasing the lift cords allows gravity to act on the base rail and the collapsed slats, dropping the base rail to its lowest level, or to a desired lower level depending on the extent to which the lift cords have been released. Conventionally the base rail is secured at a desired level by locking the lift cords in place, and this is conventionally done by a cord lock mechanism in the head rail, which mechanism is engaged and released by tugging the lift cords at an angle from the vertical.

The above-described conventional blind control is widely used throughout the world, but nevertheless presents a safety problem. The problem is that infants and small children can become entangled in the dangling lift cords, too often resulting in death or injury from strangulation or as a result of restricted blood flow. This danger has resulted in the development of devices for making the loose lift cords inaccessible to such potential victims by controlling or enclosing the cords. However, the result has been that such safety devices are hard to operate, require additional steps, the use of both hands or, as in the case of such motorized devices, are relatively expensive. There is therefore a need for a blind control device that can eliminate the danger of loose, dangling cords but nevertheless be relatively inexpensive and easily operable.

The blind control wand of this invention provides a means for easily controlling the vertical position of blinds, is inexpensive, and safely controls the lift cords so there is no danger of loose dangling cords. Other advantages and attributes of this invention will be readily discernable upon a reading of the text hereinafter.

SUMMARY OF THE INVENTION

An object of this invention is to provide a means for safely controlling the vertical position of a blind.

Another object of this invention is to provide a means for easily and inexpensively controlling the vertical level of a blind.

Another object of this invention is to provide a means for easily and inexpensively controlling the vertical level of a blind without freely dangling cords.

Another object of this invention is to provide for a vertical covering which can be raised, partially or completely, by pulling down, in opposition to gravity, on a set of lift cords egressing from a headrail, a device for safely confining and operating the set of lift cords.

These objects, and other objects expressed or implied in this document, are accomplished by: (1) a first cord locking mechanism, disposed in the headrail, which when not released prevents the set of lift cords from moving axially upward, the first cord locking mechanism being releasable by selective manipulation of the set of lift cords; (2) an inner elongated tube pivotally affixed to the headrail, an operative length of the set of lift cords being disposed within the inner tube; (3) a tensioner for preventing slack in the set of lift cords; (4) an outer elongated tube telescopingly slidable over a range along the length of the inner tube; and (5) a second cord locking mechanism disposed within the inner tube but affixed to outer tube, the second cord locking mechanism when not released preventing the set of lift cords from moving axially upward relative to the outer tube, the second cord locking mechanism being released to allow free movement of the set of lift cords through it and the inner tube in response to selective manipulation of the outer tube. According to this invention a covering is raised by reciprocal (up and down) movement of the outer tube relative to the inner tube a selected number of times depending on how high the covering is to be raised, and it is lowered by simultaneously releasing both locking mechanisms. Preferably the first cord locking mechanism is released by simultaneously angling the tubes laterally from the vertical and momentarily pulling down on the outer tube. The tensioner can be an accumulator which accumulates slack in the lift cords when the blinds are being raised, and which discharges slack when the blinds are being lowered. A preferable embodiment of an accumulator is a spooler which spools the set when the covering is being raised according to the amount that the covering is being raised, and which unspools the set when the covering is being lowered according to the amount that the covering is being lowered. Preferably the tensioner is a closed loop of cord to which the set of lift cords is connected, the loop being rotatable in a first direction to take up slack in the set when the covering is being raised, and the set being rotatable in the opposite direction to allow the set to move up when the covering is being lowered. In the preferred embodiment, the loop is rotated in the first direction by being grasped by the second cord locking mechanism whenever the outer tube is pulled down, and wherein the loop is rotated in the opposite direction by pull of the set of lift cords whenever the set of lift cords are moving up due to being released from both locking mechanisms; and the closed loop of cord is wound around two rollers—preferably one journaled in the headrail as part of the headrail cord lock, and the other journaled in the inner tube. Preferably the second cord locking mechanism is released for a time whenever the outer tube is pushed to and held, for said time, at an upper limit of its sliding range, and further includes a control arm having at least a cord locked position and a cord released position, and a bias urging the control arm toward its cord locked position; and the inner tube further comprises a projection disposed at the upper limit of the outer tube's sliding range, the control arm being forced by reaction to the projection to its cord released position whenever the outer tube is at the upper limit of its sliding range. Preferably the first cord locking mechanism includes a housing; a roller journaled in the housing; a serrated cylinder juxtaposed with roller, the set of lifts cord passing between the roller and the cylinder and wrapping partially around the roller, the cylinder having a range of radial movement between a rest position and a cord-locked position at which the set of lift cords is wedged between the cylinder and the roller; and a rack angled toward the roller and disposed within the cylinder's range of movement, vertically upward axial movement of the set of lift cords tangentially dragging the cylinder from its rest position toward the rack which in turn guides the dragged cylinder to its cord-locked position. Preferably the second cord locking mechanism includes a body defining an upwardly narrowing, vertically oriented channel, the set of lift cords passing through the channel; an obstruction disposed in the channel, the set of lift cords passing around the obstruction, the obstruction being too large to pass through the narrowed channel when the cords are also in the channel; a bias for urging the obstruction upward in the channel to wedge the cords between the obstruction and the narrowed channel walls, the cords being axially slippable by the obstruction whenever the body is moving upward relative to the cords; and a release lever selectively operable against the bias to push the obstruction low enough in the channel to release the cords while the lever is being operated.

BRIEF DESCRIPTION OF THE DRAWINGS

FIGS. 5A through 5C are an end view, front elevation view, and a cross-sectional view, respectively, of a plunger according to this invention. The cross-sectional view, FIG. 5C, is taken along 5C—5C of FIG. 5B.

FIG. 6A is a cross-sectional view taken along line 6A—6A of FIG. 2. FIGS. 6B and 6C are cross-sectional views, taken along lines 6B—6B and 6C—6C, respectively, of FIG. 6A, illustrating unlocked cords. FIG. 6D is also a cross-sectional view taken along line 6C—6C of FIG. 6A, but 6D illustrates locked cords.

FIG. 7A is a pictorial view of same, and FIGS. 7B and 7C are cross-sectional views taken along lines 7B—7B and 7C—7C, respectively, of FIG. 7A. FIG. 7D is a cross-sectional view taken normal to a headrail to which a bracket according to this invention is affixed by snap-fit.

DESCRIPTION OF THE PREFERRED EMBODIMENT

Figure 1:
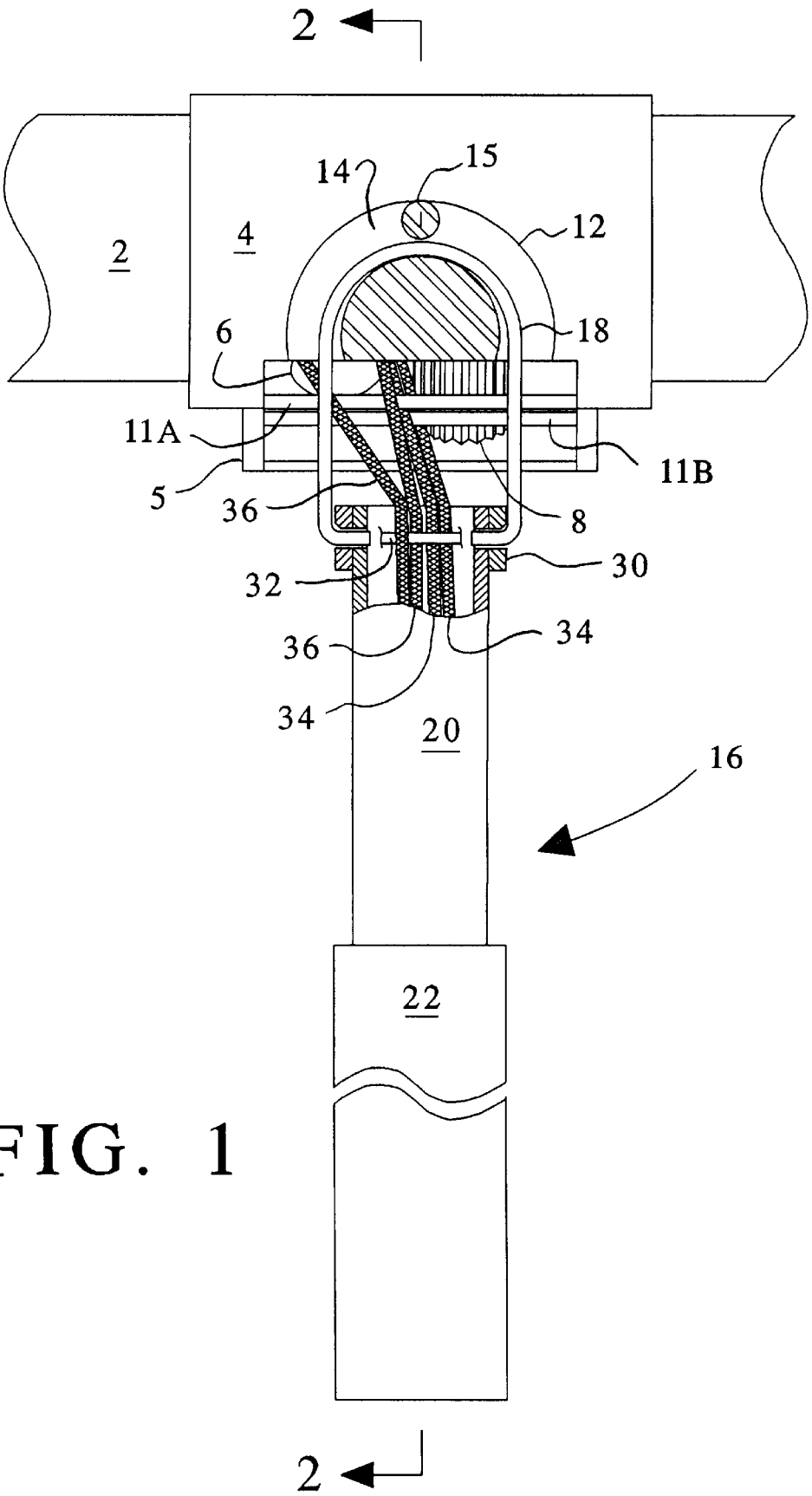
FIG. 1 is a front elevational view, partially cut away, of a preferred embodiment of this invention.
Figure 2:
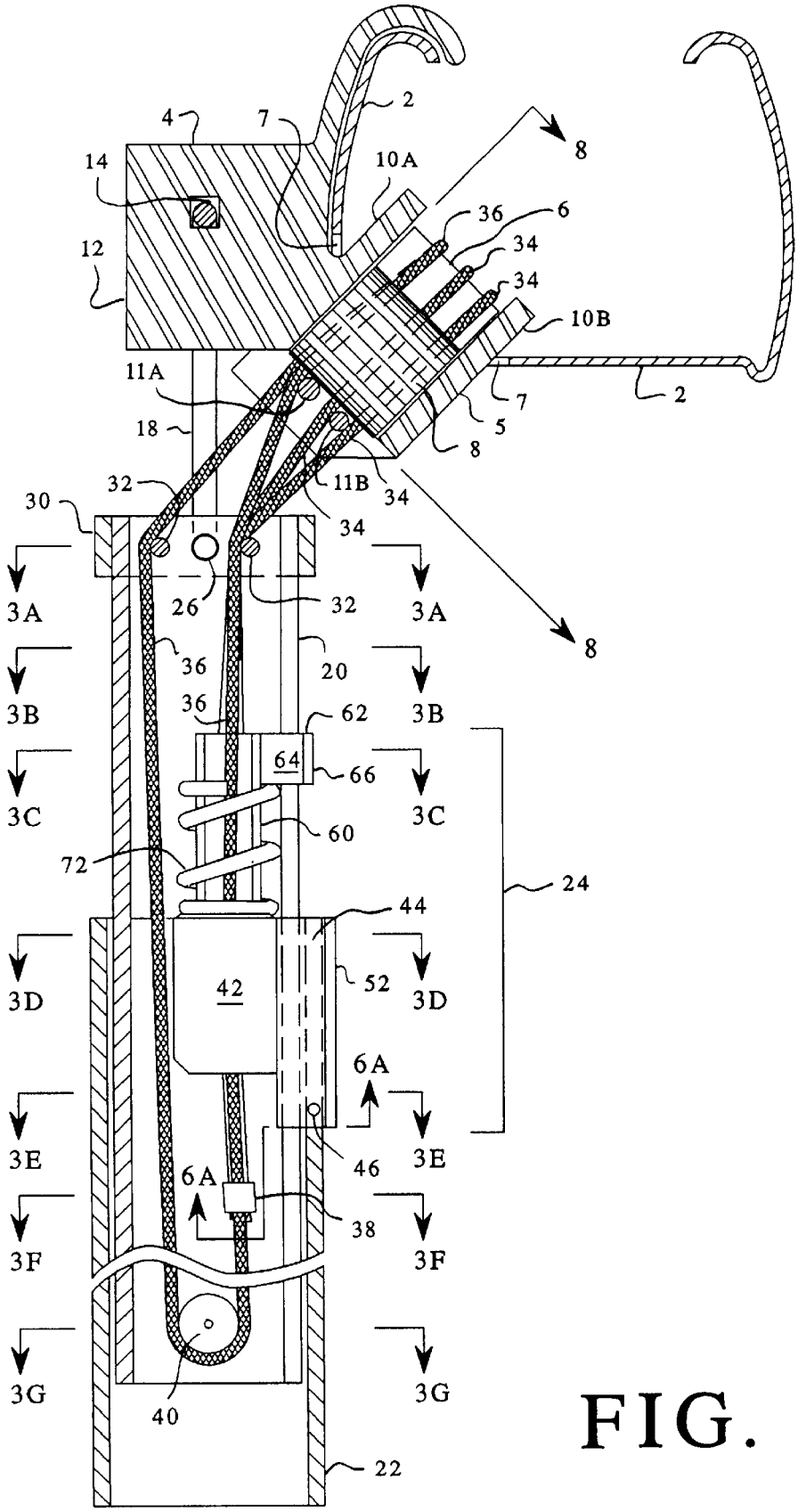
FIG. 2 is a cross-sectional view taken along line 2—2 of FIG. 1.
Figure 3A:
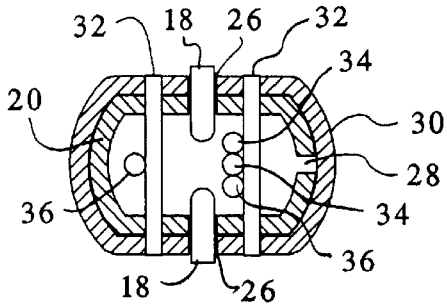
FIGS. 3A through 3G are cross-sectional views taken along lines 3A—3A through 3G—3G, respectively, of FIG. 2.
Figure 3B:
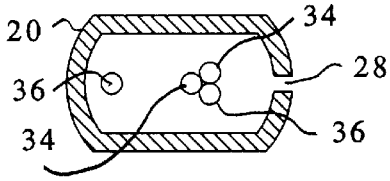
Figure 3C:
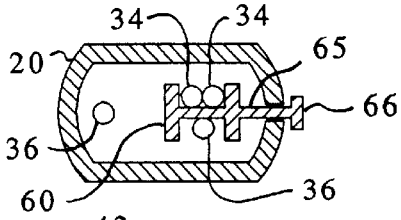
Figure 3D:
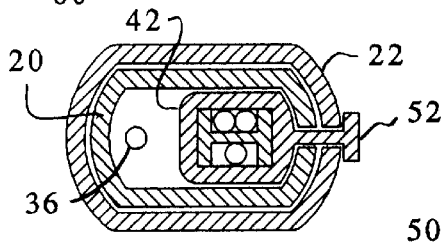
Figure 3E:
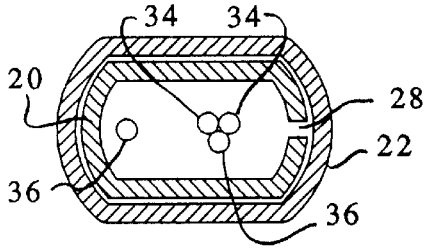
Figure 3F:
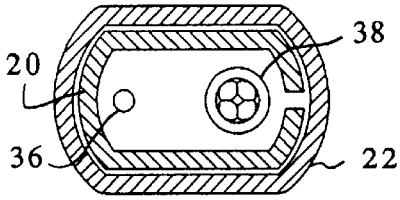
Figure 3G:
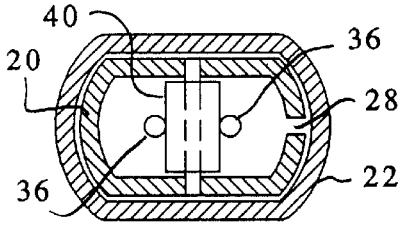
Figure 4D:
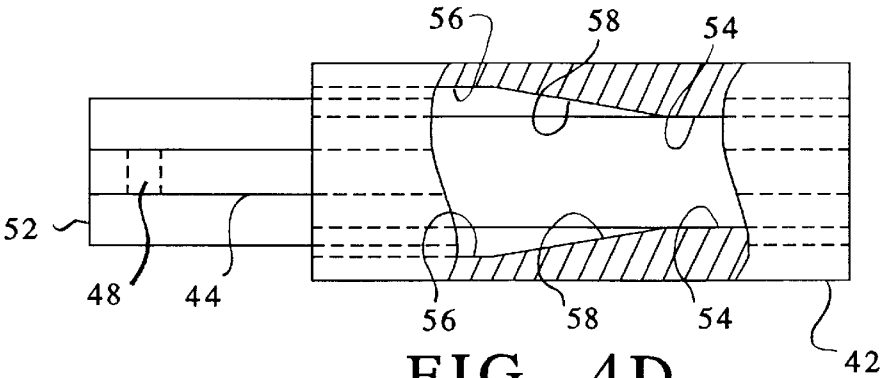
FIGS. 4A through 4D are an end view, front elevation view, opposite end view, and a top view partially cut away, respectively, of a cord lock body according to this invention.
Figure 4B:
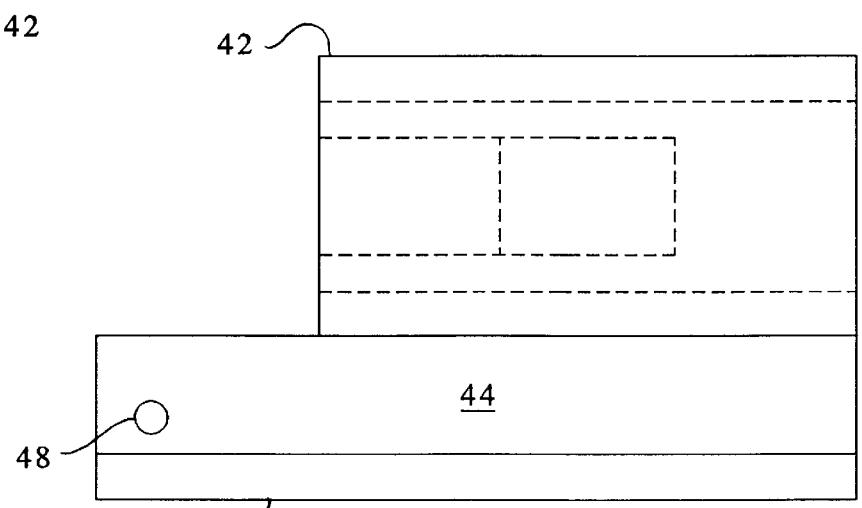
Figure 4C:
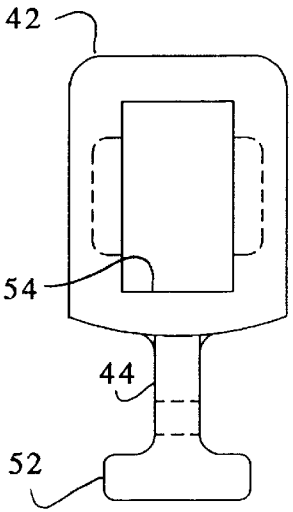
Figure 4A:
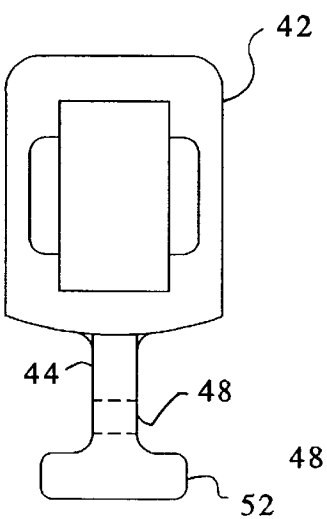
Figure 6B:
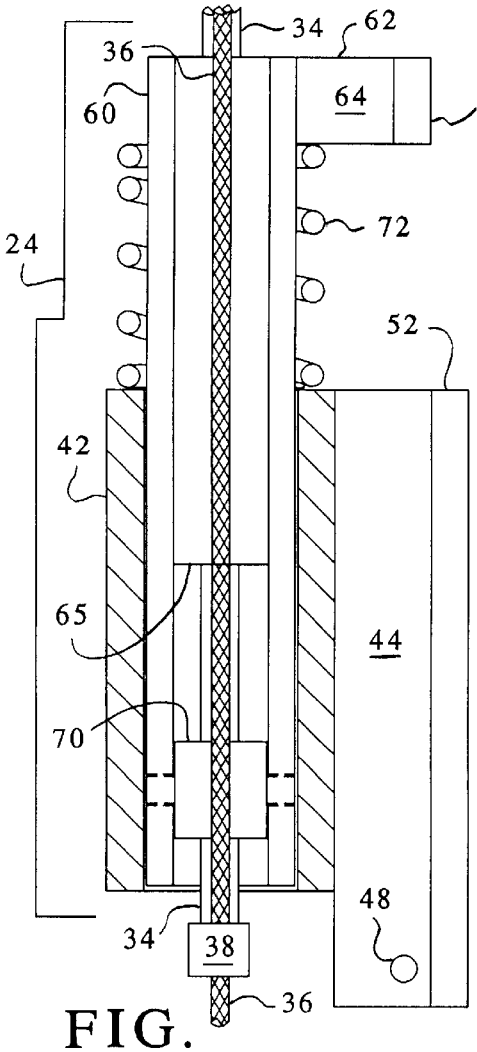
FIGS. 6A through 6D are views showing the cooperation of a cord lock and plunger according to this invention.
Figure 6C:
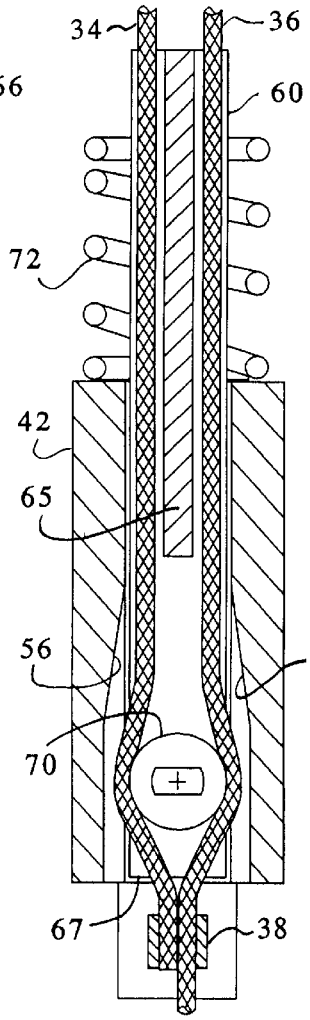
Figure 6D:
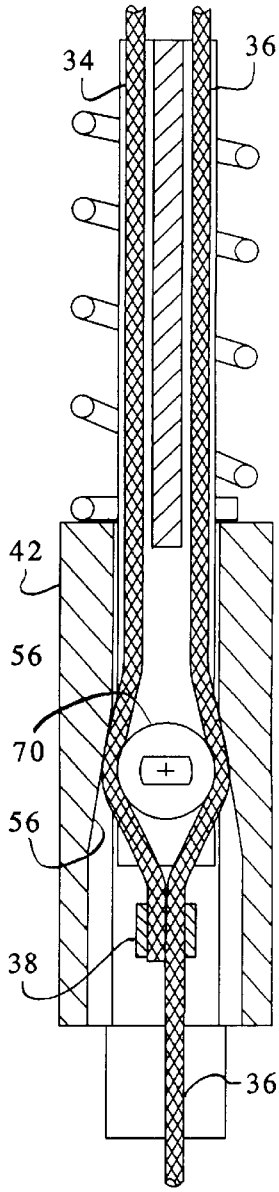
Figure 6A:
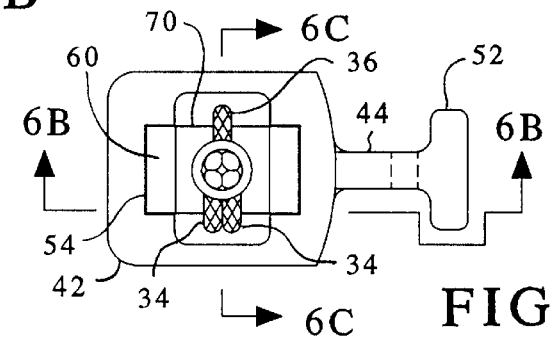
Figure 7A:
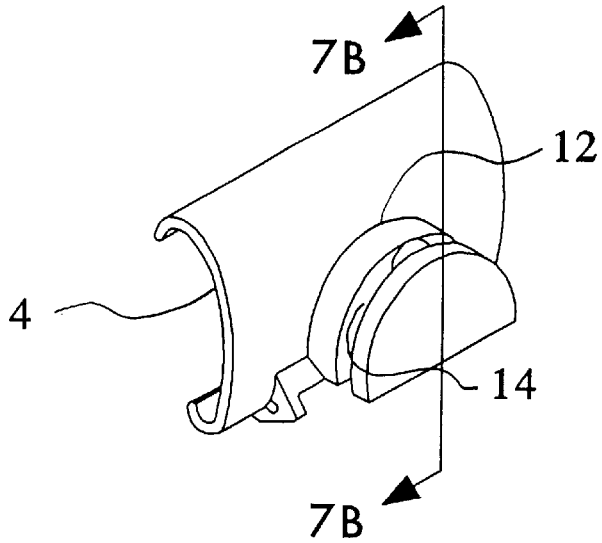
FIGS. 7A through 7D are views illustrating a preferred headrail mounting bracket.
Figure 7C:
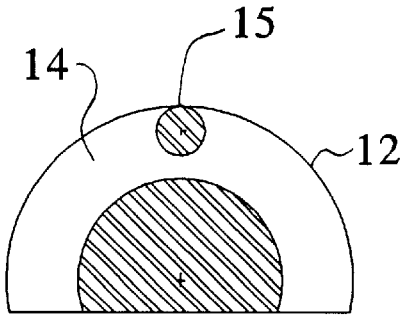
Figure 7B:
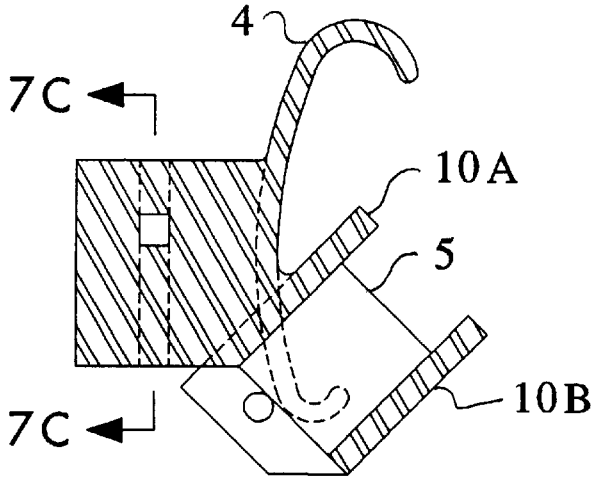
Figure 7D:
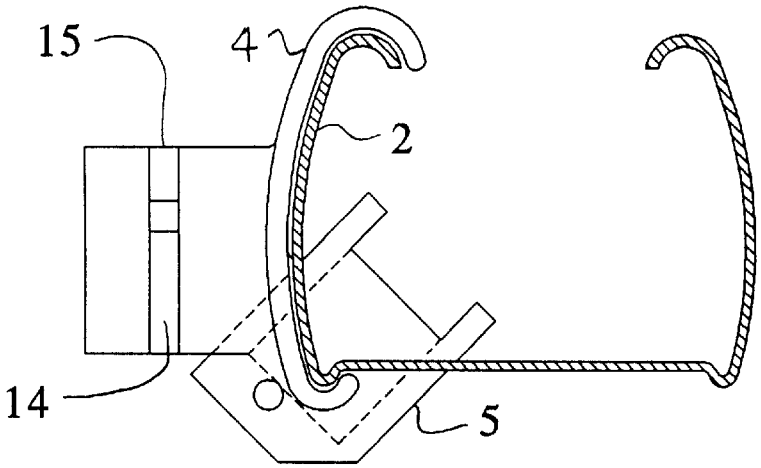
Figure 8:
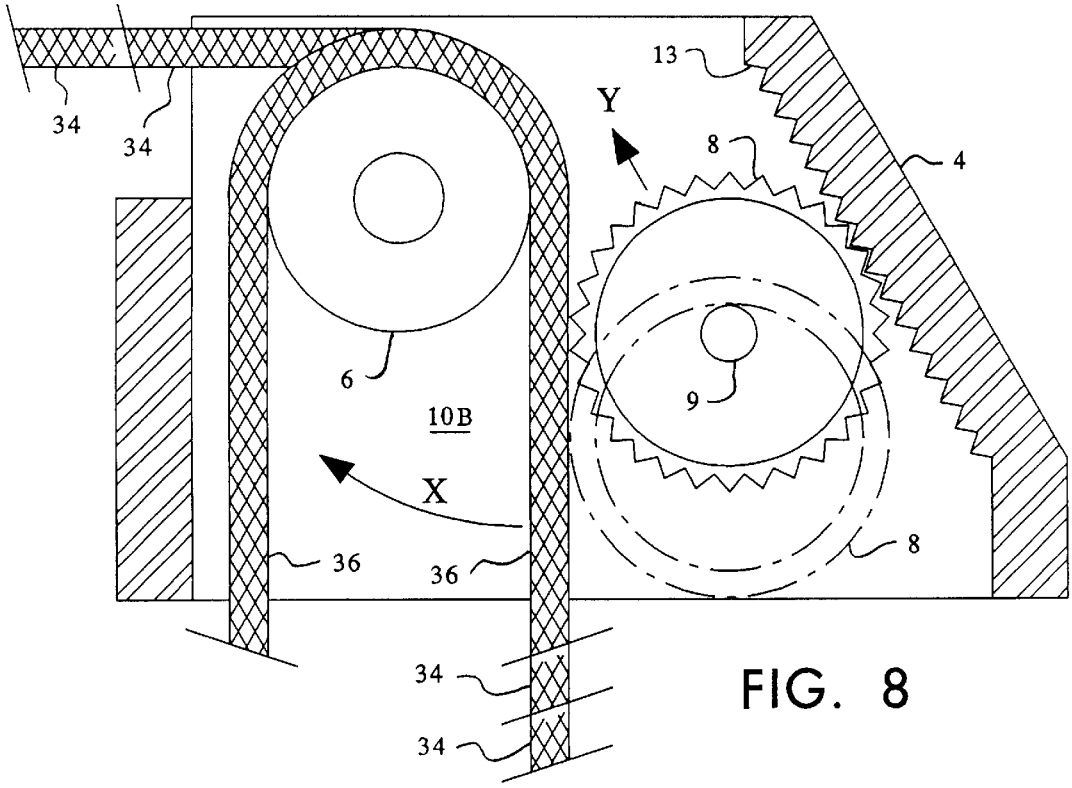
FIG. 8 is a cross-sectional view taken along line 8—8 of FIG. 2 illustrating in more detail a headrail cord locking mechanism according to this invention.
Figure 9:
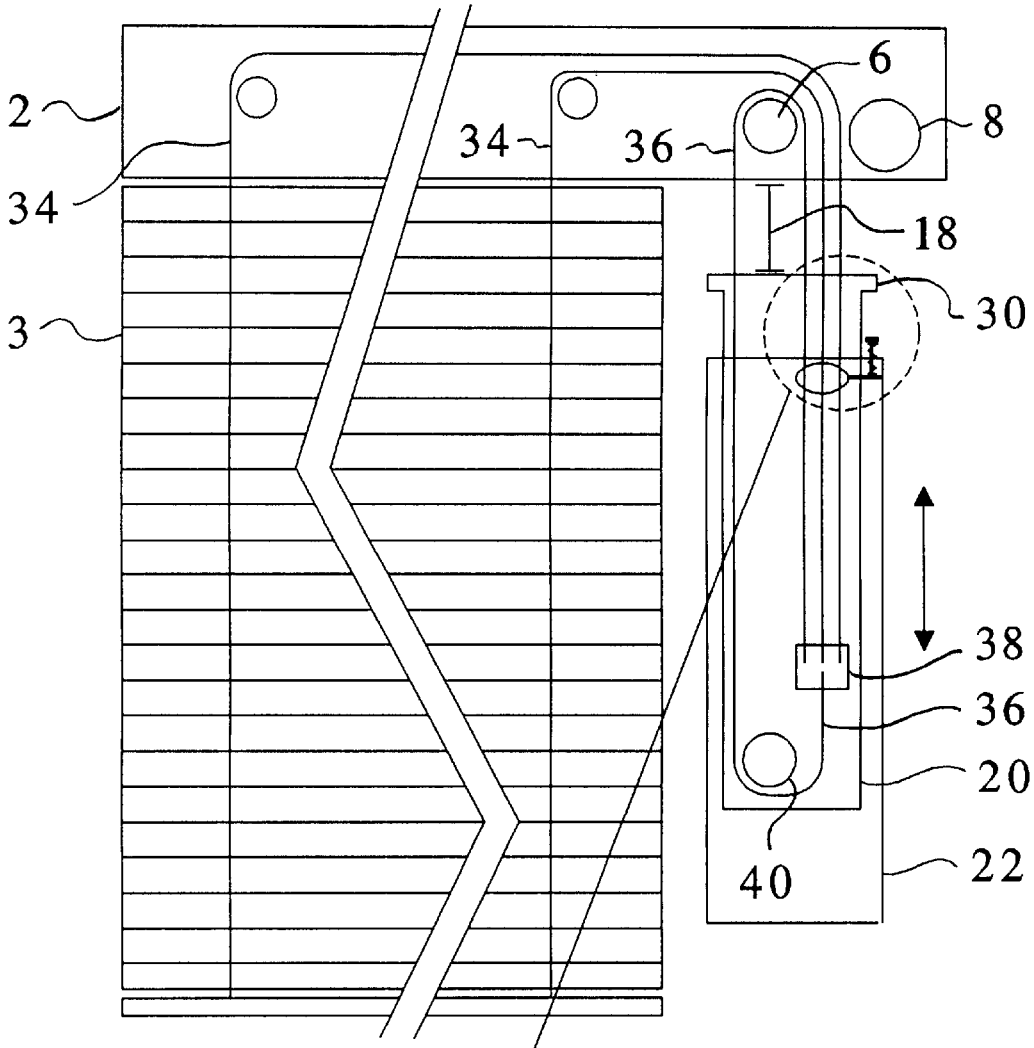
FIG. 9 is a diagrammatical illustration of this invention adapted to control a window type blind.
Figure 10:
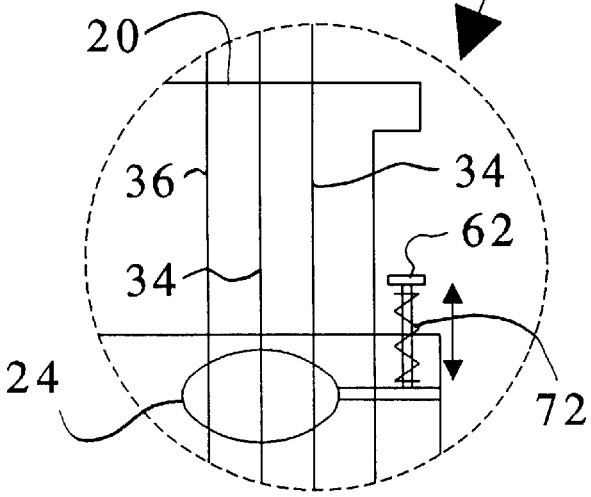
FIG. 10 is a detail view of a section of FIG. 9.

Referring to FIGS. 1, 2, and 7A through 10, a headrail 2 of a conventional set of horizontal blinds 3 is slightly modified to accommodate this invention. Mounted on the headrail, preferably by a snap fit, is a mounting bracket 4 including an angled (preferably 45 degrees), integral cord-lock housing 5 which projects into the interior channel of the headrail through a cutout 7 in the headrail. As best illustrated in FIG. 7D, the mounting bracket 4 is preferably snap fitted to the headrail 2 by a resilient face that conforms to the profile of the headrail face at the mounting area but extends further to catch prominent extremities of the headrail face. The bracket is preferably affixed proximate an operative end of the headrail and replaces a conventional cord-lock mechanism typically located there. Contained within the cord-lock housing are a roller 6 journaled in opposite, angled sides, 10A and 10B, of the housing so as to freely rotate on its axis, and an externally serrated, hollow cylinder 8 also extending between the two angled sides. The cylinder is preferably serrated by uniformly triangular, uniformly distributed, axially elongated teeth, and is confined within the housing by a parallel pin 9 extending between, and affixed to, the angled housing sides, 10A and 10B. Since the diameter of the pin 9 is much less than the inner diameter of the serrated cylinder, the cylinder has a range of movement, e.g., as indicated by the arrow Y and the phantom lines. At rest in a cord-unlocked state the cylinder rests on the pin as shown by the phantom lines, due to gravity. A plurality of cords, "lift" cords 34 and "loop" cord 36, pass between the roller and the serrated cylinder and wrap partially around the roller.

In operation, when the cords in between the roller and the cylinder move axially upward, i.e., the cords are urged counterclockwise around the roller 6, the cords catch the serrations of the cylinder thereby dragging it upward and against an angled rack 13 defined by a wall of the housing, the teeth of the rack being meshable with the serrations of the cylinder. The angle of the rack directs the upwardly rotating cylinder further against the cords and closer to the roller, as shown by arrow Y, until the cylinder has wedged the cords between the roller and itself thereby preventing further upward movement of the cords. Due to the teeth of the cylinder pressing into the cords, the cylinder will be held in place until the cords are angled away from the cylinder in a direction as shown by the arrow X and momentarily pulled in a clockwise direction with respect to roller 6. This action releases the serrated cylinder allowing it to drop down to its rest position on pin 9. With the cylinder in its rest position and the cords so angled away from the cylinder, the cords can be freely move around the roller 6 under the control of a lift wand as described below. It should also be realized that angling the cords in a direction opposite to arrow X more quickly engages the cord lock.

Referring to FIGS. 1, 2, 8, and 7A through 7D, also affixed to walls of the cord-lock housing 5 are a pair of cord guide pins, 11A and 11B, which extend between lateral walls of the housing immediately below the cord-lock mechanism and normal to the cords, 34 and 36. The cord guide pins serve to keep the cords separated from one another just before they enter the cord-lock mechanism to prevent them from becoming intertwined and entangled as they pass through the cord-lock. A semi-cylindrical boss 12 projects forwardly from the mounting bracket 4 and defines an annular groove 14 in which is hung a wand hanger 18 (which will be further explained below), which groove is closed at the apex 15 of the boss to prevent the wand hanger from moving vertically out of the groove.

As used herein, the terms "up," "upper," "down," "downward," and "forward" are arbitrarily selected directional references with "up" and "upper" referring to the general upward direction, away from the center of the earth, "down" and "downward" referring to the opposite direction and "forward" referring to the general direction toward the viewer of FIG. 1, away from the plane of the blinds.

Referring to FIGS. 1, 2, 9 and 10, the lift wand, generally designated 16, is shown in its preferred relation with the headrail 2, supported from the boss 12. The wand generally includes the wand support 18, an elongated inner tube 20, an elongated outer tube 22, referred to herein as a "handle," slidable along and over the inner tube, and a wand cord-lock mechanism 24 affixed to the top of the handle but traveling within the inner tube. The wand support 18 is preferably a rigid metal bar or wire having generally a "U" shape, the inverted saddle of the "U" being disposed in the annular channel 14 of the mounting bracket boss 12. The free ends of the "U" have right-angled bends to catch and hold the top end of the inner tube 20, the bends being disposed in opposite holes 26 defined through an upper margin band 30 and the inner tube's upper margin. In operation, the support 18 allows the lift wand 16 to be freely pivoted about the boss 12 in a lateral direction (e.g. see arrow X of FIG. 8) to angle the cords with respect to the headrail cord lock for the purpose of releasing, or engaging, the headrail cord lock, as explained above. Also, the support could as well be any kind of pivotal connected to the bracket, e.g., a ball joint or such.

Referring to FIGS. 2, 3A through 3G, and 9, the inner tube 20 and handle 22 have generally oval cross-sections with flat sides and curved ends with the handle slidably enclosing the inner tube. Other cross profiles, such as circular, oval and polygonal, could as well be used. The inner tube defines a slot 28 extending longitudinally along one side. A narrow annular band 30 encircles the upper margin of the inner tube 20 for structural support and to also serve as a stop for the wand cord locking mechanism 24, as will be explained later in more detail. Also traversing the top margin of the inner wand are two guide pins 32 which serve to redirect cords, 34 and 36, between the headrail cord-lock mechanism and the lift. The control ends of two lift cords, both designated 34, from the blind 2 are disposed within the inner tube 20. (As used herein the term "control ends" used with reference to a blinds' lift cords refers to the cords' ends conventionally dangling from a headrail and which are pulled by a user to lift the blinds.) The lift cords are kept suitably taut in the wand by means of a tensioner, illustrated herein to be a "loop" cord 36 to which the lift cords are connected by means of a connection device illustrated herein to be a crimped band 38. "Suitably taut" means that the tensioner keeps the lift cords taut enough to allow the wand to function as described herein, but not so taut as to introduce friction which would interfere with the raising or lowering of the blinds. The loop cord is wrapped in a loop around the headrail roller 6 and a roller 40 journaled within a distal end of the inner tube, and the ends of the loop cord are connected together by the crimped band. One of the pins 32 serves to guide two legs of the lift cords and one leg of the loop cord between the headrail roller 6 and the wand cord-lock mechanism 24, allowing them to be guided from the roller 6 and aligning them to properly pass through the wand cord-lock mechanism. The other pin 32 serves as a cord guide for the return path of the loop cord to the upper roller 6 after passing around the lower roller 40.

As can be seen, the inner tube telescopes, i.e., slides in and out of the outer tube within limits. Preferably the overall wand length when the tubes are fully telescoped is about 2–3 inches longer than one-half the blind drop. So for a typical blind drop of 72", then maximum wand length is preferably 38"–39".

Referring to FIGS. 2, 3A–3G, 4A–4D, 5A–5C and 6A–6D, the wand cord-lock mechanism 24 has a body 42 having a generally tubular construction, sized and shaped to provide a slip fit within the inner tube 20, and having a longitudinal rib 44 extending the length of the body and beyond at one end, which rib slip fits in the in the inner tube's slot 28. At its upper end the handle 22 defines a longitudinal slot 50 to accommodate the rib, and preferably the end of the rib extending beyond the body 42 defines a hole 48 to accommodate a pin 46 or similar securing fastener which mates with a hole (not shown) defined in a wall of the slot 50 to affix the body to the handle. Preferably the rib terminates in a perpendicular flange 52 extending the length of the rib, which flange maintains the correct orientation of the body, preventing the body from pivoting on pin 46 as the handle slides over the inner tube during operation. The flange abuts the outer surface of the handle at the edges of the slot 50 and any pivoting force is overcome by the interference of the flange with the handle. The body 42 defines a generally rectangular cavity 54 extending longitudinally through the body. The cavity is centered in the body with its long and short sides parallel with the body's long and short sides, respectively. In addition, the cavity has two opposing, side extensions 56 generally centered on the long sides of the cavity's rectangular cross-section, generally perpendicular to the rib 44. The cavity has three distinct sections, each preferably approximately one-third of the body in length. The top section, distal from the hole 48, has a rectangular cross-section 54. The rectangular cross-section continues through the entire length of the body. However, in the second section, the middle-third of the body, the inner walls (parallel with the rib) angle outwardly, narrowing the walls and creating opposed angled ramps 58 which terminate at the cavity's side extensions 56. In the third section, proximate the hole 48, the body's inner and outer walls are parallel and the cavity has no angled surfaces.

Referring again to FIGS. 2, 3A–3G, 4A–4D, 5A–5C and 6A–6D, a control arm 60, also referred-to herein descriptively as "plunger," has a cross-profile in the general shape of an "I" beam including a connecting web 65 and normal flanges 67. The plunger is sized and shaped to slide freely in reciprocal fashion within the rectangular cavity 54 of the wand cordlock mechanism body 42. (It should be noted that the plunger could have a variety of crosssections, e.g. rectangular, cross, tubular (rectangular or oval), but in the preferred embodiment the I-beam cross-section is used.) A release trigger 62 is illustrated to be in the form of a "T" shaped tab 64 projecting laterally from the top of the plunger, and is preferably aligned with the I-beam web 65, the head of the "T" being a flange 66 perpendicular to the rib. Preferably the tab extends only approximately ten to fifteen percent (10–15%) longitudinally down the length of the plunger or just sufficient to provide structural strength for the trigger which, when pushed against the stop 30 (see FIGS. 2 and 3A) will not break or be deformed. The web 65 extends from the top of the plunger to a point sufficient for structural integrity of the plunger, illustrated in this embodiment to be about sixty to seventy percent (60–70%) down the length of the plunger where the web terminates. Proximate the bottom end of the plunger is disposed a cylinder 70 extending fully and normally across the gap (left by the termination of the web 65 above) between the flanges 67. The cylinder is held centrally in place by pins 68 projecting from its ends which are seated in mating slotted holes defined in the flanges 67. Preferably the cylinder's diameter is no greater than the width of the flanges so as not to interfere with the plunger's slip-fit in the rectangular cavity 54 of the cordlock body 42. Alternatively the cylinder 70 can be a free roller.

Referring to FIGS. 2, 3A–3G and 6A–6D, the wand cord locking mechanism 24 is shown assembled by inserting the plunger 60 through a coiled helical spring 72 and into the rectangular cavity 54 of the cord-lock body 42 with the release trigger 62 in line with the rib 44 of the body 42. The inner diameter of the spring is at a minimum a slip fit over the plunger. The bottom of the spring abuts the cordlock body and is retained at the top by the tab 64. The assemblage of the body 42 with the plunger therein surrounded by the spring is then inserted into the inner tube 20 with the tab 64 and rib 44 extending through the slot 28 in the inner tube. The cords are strung such that they pass through the spring, alongside the plunger's I-beam web, and through the cord-lock body 42. Preferably the lift cords 34 are strung along one side of the I-beam web and the loop cord 36 is passed along the other side of the I-beam web. This helps to keep the cords from becoming entangled. The lift cords and the loop cord are passed through the cordlock body cavity and are gathered together below the body where they are joined with the other leg of the loop cord 36 after it has been passed over the other pin 32 and around the bottom roller 40. Crimp band 38 is slipped over the the gathered ends of the lift cords and the loop cord and is crimped to hold the ends together. The crimp is preferably a steel or aluminum band which can be crimped using a common crimping tool. Other methods of joining the ends of the cords can be used as well, such as stitching or lacing them together, adhesively joining them, tying the ends together, or with the proper cord material, fusing them together by the use of heat. With the cord-lock mechanism 24 installed in the inner tube 20 and the cords properly routed and secured, the handle 22 can be attached. It is slipped over the lower end of the inner tube and with the rib 44 positioned in the short slot 50 in the top of the handle, pin 46 is inserted through hole 48 and preferably pressed into an aligned hole (not shown) defined in the handle.

Referring again to FIGS. 2 and 6A–6D, with the cords installed, the spring 72 cannot fully extend and is held in partial compression, biasing the plunger 60 upward so that the cylinder 70 is constantly urged against the cord-lock body's opposing ramps 56. This causes the cylinder to wedge, i.e., compress the cords between it and the ramps, best shown by FIG. 6D. Since there is only a slip fit for the cylinder to pass through the cavity 54 in the cordlock body 42, the cords create an obstruction, preventing the spring from pushing the body off of the plunger because without the cords, the body would slip off of the plunger. The force of the spring is sufficient to keep the cord-lock mechanism 24 held in position, preventing it from slipping to the bottom of the inner tube 20 due to its own weight and that of the handle 22.

In operation, the wand cord-lock mechanism and the headrail cord-lock mechanism work in conjunction with each other. The headrail cord-lock mechanism functions to lock the lift cords 34 and the loop cord 36 between the roller 6 and the serrated cylinder 8 whenever the wand 16 is in the vertical or "neutral" position. This prevents upward axial movement of the cords relative to the headrail cord lock, but not downward movement. When the cords are thus locked and there is no downward axial movement, the blinds will stay wherever they are positioned. This will also lock the loop cord since both the lift cords and the loop cord pass over the headrail's cord-lock roller and will be locked by the headrail's serrated cylinder preventing the cords from slipping or moving axially upward. The headrail cord-lock mechanism releases the cords whenever the wand is pivoted on its support 18 to the left and the handle momentarily pulled down because pivoting the wand left causes the cords to be angled away from interference with the serrated cylinder, except at the point where the cylinder is holding the cords against the cord-lock roller. The slight momentary tug on the handle likewise tugs the cords and disengages them from the serrated cylinder, and since it is not restricted by the cords, the cylinder falls away from the roller by gravity until stopped by its securing pin. When the wand is returned to its neutral position, the cords again are caught by the serrated cylinder, but so long as the cords are moving axially downward from the headrail roller, as is the case when the cords are being pulled down by pulling on the wand's handle, the headrail cord lock will not restrict or lock the cords. However, each time the handle is pushed up, gravity will try to move the lift cords axially upward and the headrail cord lock will again catch them. As for the wand cord lock, pushing the handle upward allows the cords to slip through the wand cord lock because the loop cord will prevent the lift cords from rising with the handle and so the wand cord lock cylinder 70 will become dislodged sufficiently to allow the cords to slip by it as long as the handle is moving upward relative to the inner tube. However when the handle is pulled downward, the cords will be locked in the wand cord lock and be pulled down along with the handle. In this way blinds can be raised by pumping the handle up and down depending on how high the blinds are to be raised.

As for lowering the blinds, both cord locks must be released simultaneously for a time. This is done by releasing the headrail cord lock as previously explained and simultaneously pushing the handle to its upper limit at which the wand cord-lock release trigger 62 is forcibly pressed against the stop 30, at the top of the inner tube. The reaction force against the trigger compresses the spring 72 enough to release the wand cord lock. When both cord locks are released simultaneously, the lift cords are free to move axially in response to gravity acting against the blinds' bottom rail and any collapsed slats resting on the bottom rail. When the blinds have been lowered to a desired point, the wand is then returned to its neutral position at which the headrail cord lock comes back into play.

The loop cord keeps tension on the lift cords by causing the them to effectively "spool" whenever manipulation of the handle would otherwise cause slack in the lift cords, i.e., when the blinds are being raised. Whenever the handle is pulled down to raise the blinds, the leg of loop cord passing through the wand cord lock is likewise pulled down causing the loop cord to rotate clockwise around its loop, and this loop cord rotation in turn pulls the lift cords around with it, effectively spooling the lift cords around loop cord's loop and avoiding slack in the lift cords. Whenever the handle is being pushed up, as when it is being pumped to raise the blinds, the loop cord is caught by the headrail cord lock and prevented from counterclockwise rotation; this anchors the lift cords keeping enough tension on them to cause them to slip through the wand cord lock while the handle is being pushed up, as explained above. Whenever the handle is manipulated to release the lift cords from both cord locks, e.g., to lower the blinds, the loop cord is also released from both cord locks and freely rotates counterclockwise so as not to hinder the lift cords from unspooling, i.e., moving axially in an upward direction.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, although the embodiment of the tensioner described herein is a loop cord cooperating with the cord locks to spool and unspool the lift cord set, the tensioner can be expressed in any embodiment which accumulates slack in the lift cords when the blinds are being raised, and which proportionally discharges slack when the blinds are being lowered.

We claim:

1. For a vertical covering which can be raised, partially or completely, by pulling down, in opposition to gravity, on a set of lift cords egressing from a headrail, a device for safely confining and operating the set of lift cords comprising:

(a) a first cord locking mechanism, disposed in the headrail, which when not released prevents the set of lift cords from moving axially upward, the first cord locking mechanism being releasable by selective manipulation of the set of lift cords;

(b) an inner elongated tube pivotally affixed to the headrail, control ends of the set of lift cords being disposed within the inner tube;

(c) a tensioner for preventing slack in the set of lift cords;

(d) an outer elongated tube telescopingly slidable over a range along the length of the inner tube; and (e) a second cord locking mechanism disposed within the inner tube but affixed to outer tube, the second cord locking mechanism when not released preventing the set of lift cords from moving axially upward relative to the outer tube, the second cord locking mechanism being releasable to allow free movement of the set of lift cords through it and the inner tube in response to selective manipulation of the outer tube;

(f) the covering being raisable by reciprocal movement of the outer tube relative to the inner tube a selected number of times depending on how high the covering is to be raised, the covering being lowerable by simultaneously releasing both locking mechanisms.

2. The device according to claim 1 wherein the first cord locking mechanism is released by simultaneously angling the tubes laterally from the vertical and momentarily pulling down on the outer tube.

3. The device according to claim 1 further comprising an accumulator which accumulates slack in the lift cords when the blinds are being raised, and which proportionally discharges slack when the blinds are being lowered.

4. The device according to claim 1 wherein the tensioner comprises a spooler which spools the set when the covering is being raised according to the amount that the covering is being raised, and which unspools the set when the covering is being lowered according to the amount that the covering is being lowered.

5. The device according to claim 1 wherein the tensioner comprises a closed loop of cord to which the set of lift cords is connected, the loop being rotatable in a first direction to take up slack in the set when the covering is being raised, and the set being rotatable in the opposite direction to allow the set to move axially up when the covering is being lowered.

6. The device according to claim 5 wherein the loop is rotated in the first direction by being grasped by the second cord locking mechanism whenever the outer tube is pulled down, and wherein the loop is rotated in the opposite direction by pull of the set of lift cords whenever the set of lift cords are moving up due to being released from both locking mechanisms.

7. The device according to claim 6 wherein the first cord locking mechanism when not released also prevents upwardly axial movement of the loop.

8. The device according to claim 5 further comprising:

(a) a roller journaled in the headrail, (b) a roller journaled in the inner tube, and (c) the closed loop of cord being wound around the two rollers, the set of lift cords being connected to the loop.

9. The device according to claim 1 wherein the second cord locking mechanism is released for a time whenever the outer tube is pushed to and held, for said time, at an upper limit of its sliding range.

10. The device according to claim 9 wherein:

(a) the second cord locking mechanism further comprises:

(1) a control arm having at least a cord locked position and a cord released position, and (2) a bias urging the control arm toward its cord locked position; and (b) the inner tube further comprises a projection disposed at the upper limit of the outer tube's sliding range, the control arm being forced by reaction to the projection to its cord released position whenever the outer tube is at the upper limit of its sliding range.

11. The device according to claim 1 wherein the first cord locking mechanism comprises:

(a) a housing;

(b) a roller journalled in the housing;

(c) a serrated cylinder juxtaposed with roller, the set of lifts cord passing between the roller and the cylinder and wrapping partially around the roller, the cylinder having a range of radial movement between a rest position and a cord-locked position at which the set of lift cords is wedged between the cylinder and the roller; and (d) a rack angled toward the roller and disposed within the cylinder's range of movement, vertically upward axial movement of the set of lift cords tangentially dragging the cylinder from its rest position toward the rack which in turn guides the dragged cylinder to its cord-locked position.

12. The device according to claim 11 wherein the serrated cylinder is hollow, and further comprising a pin affixed at both ends to the housing and extending axially through hollow of the serrated cylinder to secure the cylinder to the housing, the diameter of the pin being much less than the inner diameter of the cylinder to provide the cylinder its range of movement.

13. The device according to claim 1 wherein the second cord locking mechanism comprises:

(a) a body defining an upwardly narrowing, vertically oriented channel, the set of lift cords passing through the channel;

(b) an obstruction disposed in the channel, the set of lift cords passing around the obstruction, the obstruction being too large to pass through the narrowed channel when the cords are also in the channel;

(c) a bias for urging the obstruction upward in the channel to wedge the cords between the obstruction and the narrowed channel walls, the cords being axially slippable by the obstruction whenever the body is moving upward relative to the cords; and (d) a release lever selectively operable against the bias to push the obstruction low enough in the channel to release the cords while the lever is being operated.

* * * * *